US005963233A

United States Patent [19]

Shirota et al.

[11] Patent Number: 5,963,233

[45] **Date of Patent: *Oct. 5, 1999**

[54] JET RECORDING METHOD

[75] Inventors: Katsuhiro Shirota, Inagi; Genji Inada, Yokohama, both of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/794,767

[22] Filed: Feb. 3, 1997

Related U.S. Application Data

[63] Continuation of application No. 08/586,931, Jan. 3, 1996, abandoned, which is a continuation of application No. 08/093,942, Jul. 21, 1993, abandoned.

[30] Foreign Application Priority Data

Jul. 22, 1992 [JP] Japan ..... 4-195500
Jul. 22, 1992 [JP] Japan ..... 4-195504

[51] Int. Cl.[6] ..... B41J 2/07

[52] U.S. Cl. ..... 347/60; 347/88; 347/17

[58] Field of Search ..... 347/60, 11, 17, 347/88

[56] References Cited

U.S. PATENT DOCUMENTS

| | | | |
|---|---|---|---|
| 4,410,899 | 10/1983 | Haruta et al. | 346/140 R |
| 4,490,728 | 12/1984 | Vaught et al. | 346/1.1 |
| 4,712,172 | 12/1987 | Kiyohara et al. | 346/1.1 |
| 4,723,129 | 2/1988 | Endo et al. | 346/1.1 |
| 4,982,199 | 1/1991 | Dunn | 347/60 |
| 5,065,167 | 11/1991 | You et al. | 346/1.1 |
| 5,079,564 | 1/1992 | Sasaki et al. | 346/76 |
| 5,107,276 | 4/1992 | Kneezel et al. | 34/1.1 |

FOREIGN PATENT DOCUMENTS

| | | |
|---|---|---|
| 0468075 | 1/1992 | European Pat. Off. . |
| 0479501 | 4/1992 | European Pat. Off. . |
| 0511602 | 11/1992 | European Pat. Off. . |
| 4-10940 | 1/1992 | Japan . |

*Primary Examiner*—Valerie Lund
*Attorney, Agent, or Firm*—Fitzpatrick, Cella, Harper & Scinto

[57] ABSTRACT

In a jet recording method, a normally solid recording material is placed in a heat-melted state within a nozzle and heated to generate a bubble therewithin by applying a bubble-generating heat energy, thereby ejecting droplets of the recording material out of the nozzle onto a recording medium. In the method, the ejection of the recording material droplets can be stabilized by applying prior to the bubble-generating heat energy a preheating energy which decreases continuously or discontinuously.

6 Claims, 5 Drawing Sheets

JET RECORDING METHOD

This application is a continuation of application Ser. No. 08/586,931 filed Jan. 3, 1996, which is a continuation of application Ser. No. 08/093,942 filed Jul. 21, 1993, both now abandoned.

FIELD OF THE INVENTION AND RELATED ART

The present invention relates to a jet recording method wherein a droplet of a recording material is discharged or ejected to a recording medium.

In the jet recording method, droplets of a recording material (ink) are ejected to be attached to a recording medium such as paper for accomplishing recording. In the method disclosed in U.S. Pat. Nos. 4,410,899, 4,723,129 and 4,723,129 assigned to the present assignee among the known jet recording methods, a bubble is generated in an ink by applying a heat energy to the ink, and an ink droplet is ejected through an ejection outlet (orifice), whereby a recording head provided with high-density multi-orifices can be easily realized to record a high-quality image having a high resolution at a high speed.

Our research group has proposed a new jet recording method (hereinafter referred to as "bubble-through recording method"), wherein a recording material is supplied with a thermal energy corresponding to a recording signal to generate a bubble in the recording material so that a droplet of the recording material is discharged out of an ejection outlet under the action of the bubble, wherein the bubble is caused to communicate with the ambience (Japanese Laid-Open Patent Application (JP-A) 4-10940). According to the bubble-through recording method, the splash or mist of the recording material is prevented. Further, according to the bubble-through recording method, all the recording material between the created bubble and the ejection outlet is ejected, so that the discharged amount of the recording material droplet becomes constant depending on the shape of a nozzle and the position of a heater therein, whereby a stable recording becomes possible.

Our research group has also proposed a jet recording method using a normally solid recording material (i.e., a recording material which is solid at room temperature) (U.S. patent appln. Ser. No. 767,686; EP-A-0479501). If such a normally solid recording material is used, it is possible to obtain a recorded image which is excellent in fixability and is free from blurring.

In such a jet recording method using a normally solid recording material, it is necessary to impart a larger quantity of heat in order to generate a bubble than in the case of using a normally liquid recording material. In order to impart a large quantity of heat to a normally solid recording material, it is suitable to apply a preheating energy (herein used to mean a "heat energy for preliminarily heating the recording material within an extent of not generating a bubble within the recording material) prior to application of a bubble-generating heat energy (herein used to mean a heat energy for generating a bubble within the recording material), e.g., as disclosed in U.S. Pat. No. 5,065,167. The U.S. Pat. No. 5,065,167 teaches imparting a preheating energy by applying plural pulse voltages repeating at a constant interval to a heater of a recording head but has left much room for improvement in order to stably produce a large ejection pressure.

SUMMARY OF THE INVENTION

An object of the present invention is to provide an improvement in the jet recording method including application of a preheating energy.

More specifically, an object of the present invention is to provide a jet recording method which ensures the advantages of the jet recording method including application of a preheating energy and further provides a large ejection energy stably.

According to the present invention, there is provided a jet recording method, comprising: placing a normally solid recording material in heat-melted state within a nozzle, and heating the recording material to generate a bubble within the recording material by applying a bubble-generating heat energy corresponding to a given recording signal, thereby ejecting a droplet of the recording material out of the nozzle onto a recording medium, wherein the method further including prior the application of the bubble-generating heat energy a step of applying to the recording material a preheating energy which decreases continuously or discontinuously.

These and other objects, features and advantages of the present invention will become more apparent upon a consideration of the following description of the preferred embodiments of the present invention taken in conjunction with the accompanying drawings.

DETAILED DESCRIPTION OF THE INVENTION

In the recording method according to the present invention, a normally solid recording material (ink, i.e., a recording material which is solid at room temperature (5° C.–35° C.)) is melted under heating, and the melted recording material is ejected through an ejection outlet (orifice) for recording. The ejection of the recording material is effected by imparting to the melted recording material a preheating energy and then a bubble-generating heat energy.

Figure 1:
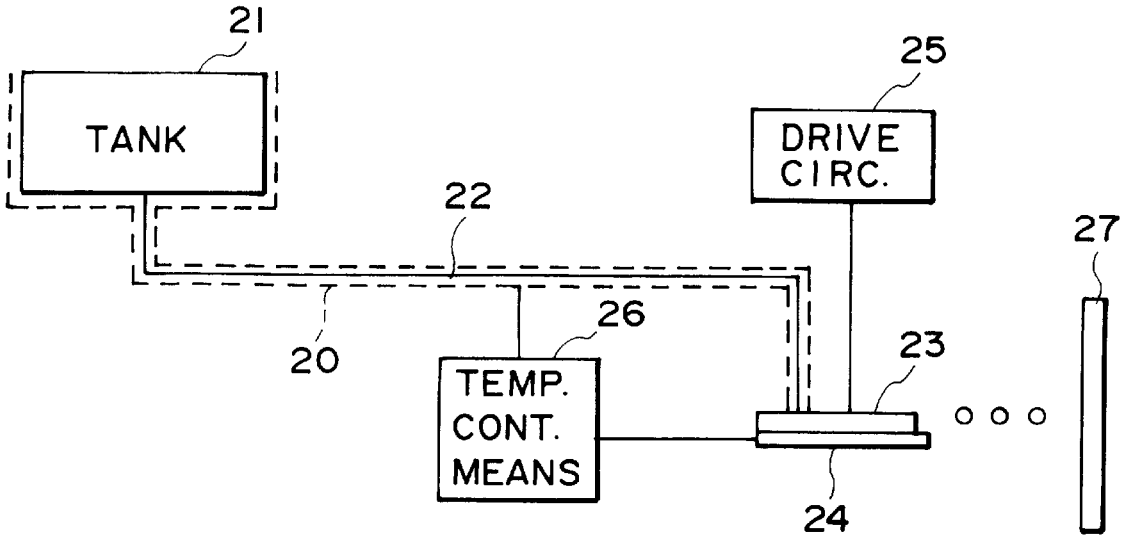
FIG. 1 is a schematic illustration of an embodiment of a recording apparatus for use in a recording method according to the invention.

FIG. 1 illustrates an apparatus for practicing the recording method according to the present invention, wherein a recording material contained in a tank 21 is supplied through a passage 22 to a recording head 23. The recording head 23 may for example be one illustrated in FIG. 2. The tank 21, passage 22 and recording head 23 are supplied with heat by heating means 20 and 24 to keep the recording material in a liquid state in the apparatus. The heating means 20 and 24 are set to a prescribed temperature, which may suitably be higher by 10–20° C. than the melting point of the recording material, by a temperature control means 26. The recording head 23 is supplied with a recording signal from a drive circuit 25 to drive an ejection energy-generating means (e.g., a heater) in the recording head corresponding to the recording signal, thereby ejecting droplets of the recording material to effect a recording on a recording medium 27, such as paper.

Figure 2:
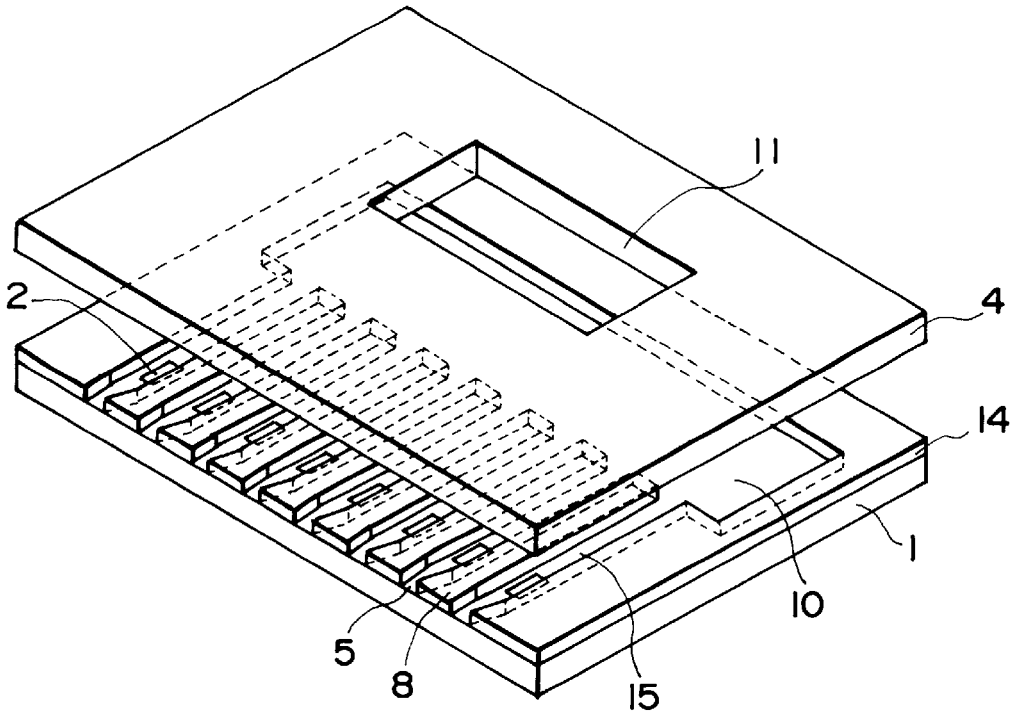
FIG. 2 is a perspective view of a recording head used in the recording apparatus shown in FIG. 1.

As shown in FIG. 2, the head 23 is provided with a plurality of walls 8 disposed in parallel with each other on a substrate 1 and a wall 14 defining a liquid chamber 10. On the walls 8 and 14, a ceiling plate 4 is disposed. In FIG. 2, the ceiling plate 4 is shown apart from the walls 8 and 14 for convenience of showing an inside structure of the recording head. The ceiling plate 4 is equipped with an ink supply port 11, through which a melted recording material is supplied into the liquid chamber 10. Between each pair of adjacent walls 8, a nozzle 15 is formed for passing the melted recording material. At an intermediate part of each nozzle 15 on the substrate 1, a heater 2 is disposed for supplying a thermal energy corresponding to a recording signal to the recording material. A bubble is created in the recording material by the thermal energy from the heater 2 to eject the recording material through the ejection outlet 5 of the nozzle 15.

In a preferred mode (bubble-through mode) of the recording method according to the present invention, when a bubble is created and expanded by the supply of thermal energy to reach a prescribed volume, the bubble thrusts out of the ejection outlet 5 to communicate with the ambience (atmosphere). The bubble-through mode is explained further hereinbelow.

Figure 3:
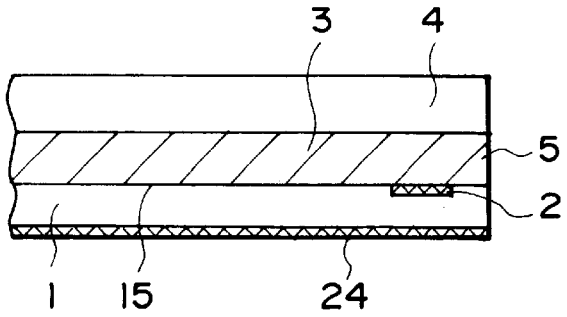
FIGS. 3–6 are schematic sectional views of a recording head respectively showing a state before generation of a bubble (FIG. 3), a state immediately after generation of the bubble (FIG. 4), state wherein the generated bubble communicates with the ambience (FIG. 5), and a state at an instant wherein a droplet of the recording material has been just ejected (FIG. 6).
Figure 4:
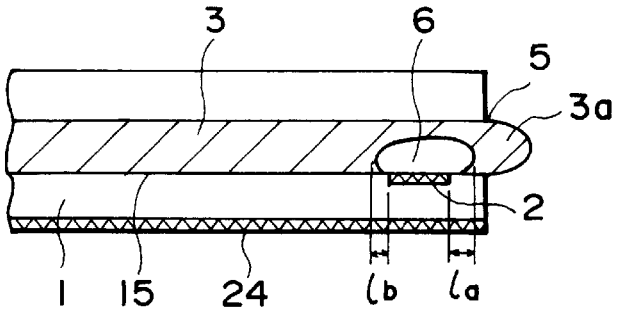
Figure 5:
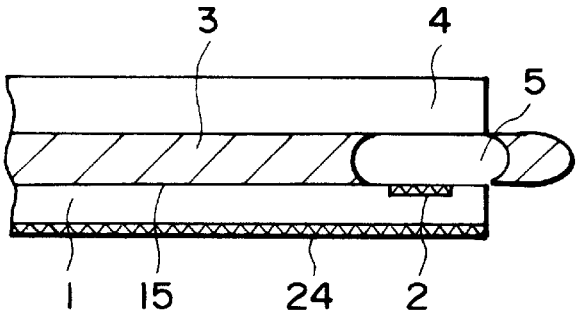
Figure 6:
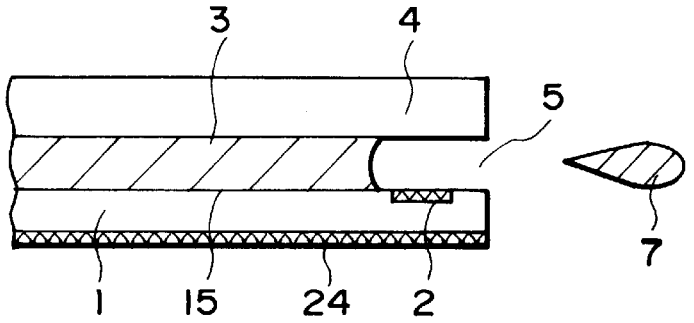

FIGS. 3–6 show sections of a nozzle 15 formed in the recording head 23, including FIG. 3 showing a state before bubble creation. First, current is supplied to a heating means 24 to keep a normally solid recording material 3 melting. Then, the heater 2 is supplied with a pulse current to instantaneously heat the recording material 3 in the vicinity of the heater 2, whereby the recording material 3 causes abrupt boiling to vigorously generate a bubble 6, which further begins to expand (FIG. 4). The bubble further continually expands and grows particularly toward the ejection outlet 5 providing a smaller inertance until it thrusts out of the ejection outlet 5 to communicate with the ambience (FIG. 5). A portion of the recording material 3 which has been closer to the ambience than the bubble 6 is ejected forward due to kinetic momentum which has been imparted thereto by the bubble 6 up to the moment and soon forms a droplet to be deposited onto a recording medium, such as paper (not shown) (FIG. 6). A cavity left at the tip of the nozzle 15 after the ejection of the recording material 3 is filled with a fresh portion of the recording material owing to the surface tension of the succeeding portion of the recording material and the wetness of the nozzle wall to restore the state before the ejection.

In contrast thereto, in a mode other than the bubble-through mode of the jet recording method according to the present invention, a bubble does not communicate with the ambience even at its maximum volume and then disappears by shrinkage.

Because the bubble created in the recording material communicates with the ambience in the bubble-through mode, substantially all the portion of the recording material present between the bubble and the ejection outlet is ejected, so that the volume of an ejected droplet becomes always constant. Further, in the bubble-through recording method, all the recording material present between the bubble and the ejection outlet is ejected so that even a small bubble is not allowed to remain on the heater.

In order to cause a generated bubble to communicate with the ambience, the heater 2 may be disposed closer to the ejection outlet 5. This is the simplest structure adoptable for communication of a bubble with the ambience. The communication of a bubble with the ambience may be further ensured by desirably selecting factors, such as the thermal energy generated by the heater 2, the ink properties and various sizes of the recording head (distance between the ejection outlet and the heater 2, the widths and heights of the outlet 5 and the nozzle 15). The required closeness of the heater 2 to the ejection outlet 5 cannot be simply determined but, as a measure, the distance from the front end of the heater 2 to the ejection outlet (or from the surface of the heater 2 to the ejection outlet 5) may preferably be 5–80 microns, further preferably 10–60 microns.

The jet recording method inclusive of the bubble-through mode according to the present invention includes, prior to application of a bubble-generating heat energy, a pre-heating step of applying to the recording material a preheating energy which decreases continuously or discontinuously with time. As a result thereof, it is possible to effectively impart a large quantity of heat energy to the recording material without causing unnecessary bubble in the preheating step, whereby the speed of recording material droplets ejected out of the ejection outlet are increased to stabilize the position of destination and obviate ejection failure.

The total quantity of the preheating energy may preferably be 5–5000 $\mu$J, particularly 15–3000 $\mu$J, per nozzle and 60–90%, particularly 65–85%, of the total preheating energy may preferably imparted in a former half period of the pre-heating step. Further to say, the total preheating energy may preferably be 5–5000 $\mu$J for ejecting a single droplet (5–50 pl) of the recording material and 2–20 times the bubble-generating heat energy.

Both the preheating energy and the bubble-generating heat energy may be applied by the heater 2 disposed within the nozzle 15. In other words, the application of the preheating energy and the bubble-generating heat energy may be performed by applying voltage pulses.

The preheating energy may be imparted by applying a plurality of voltage pulses (pre-heating pulses).

Figure 7:
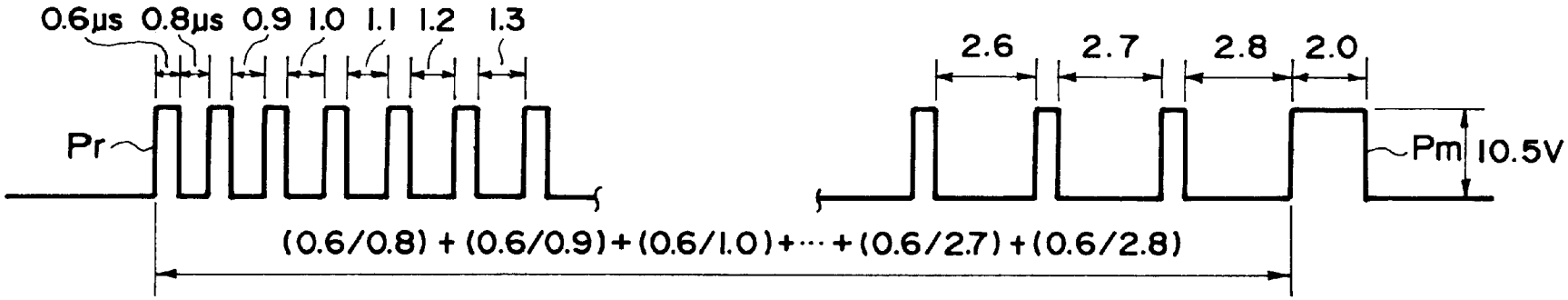
FIGS. 7–12 are respectively a waveform diagram showing an example combination of pre-heating pulses and a bubble-generating pulse.

FIG. 7 shows preheating pulses Pr among which adjacent two pulses are caused to have a spacing (pause period) which is gradually increased after application of each pulse.

Figure 8:
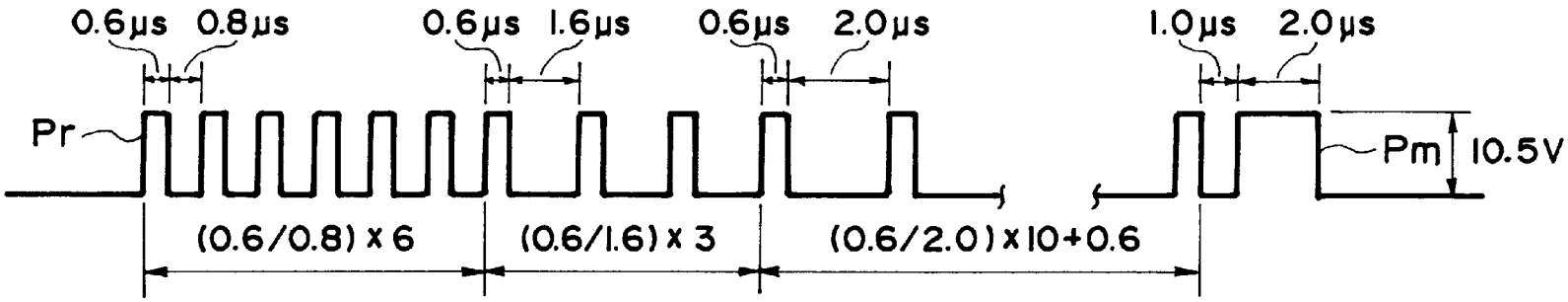

FIG. 8 shows a plurality of preheating pulses Pr including a first group of pulses having a constant pulse width and a constant pause period, a second group of pulses having a longer pause period than the first group pulses and a third group of pulses having a longer pause period than the second group pulses.

Figure 9:
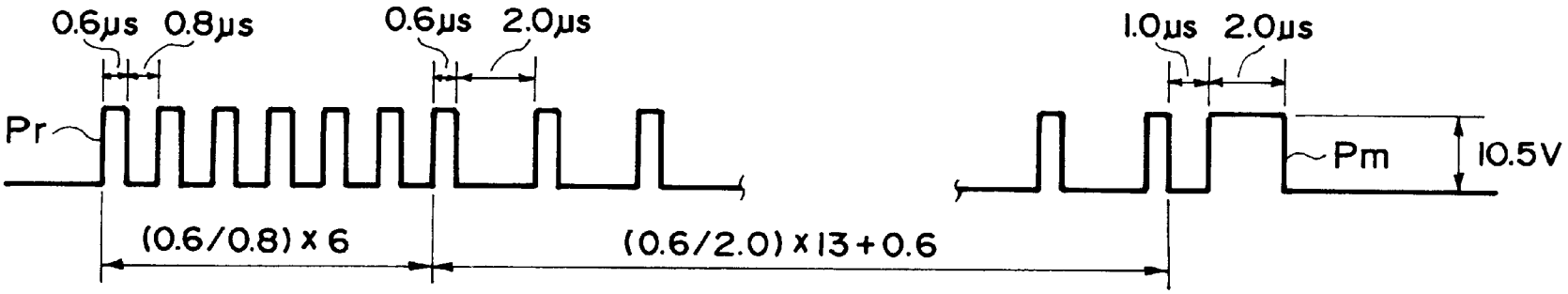

FIG. 9 shows a plurality of preheating pulses Pr including a first group of pulses having a constant pulse width and a constant pause period, and a second group of pulses having a longer pause period than the first group pulses.

Figure 10:
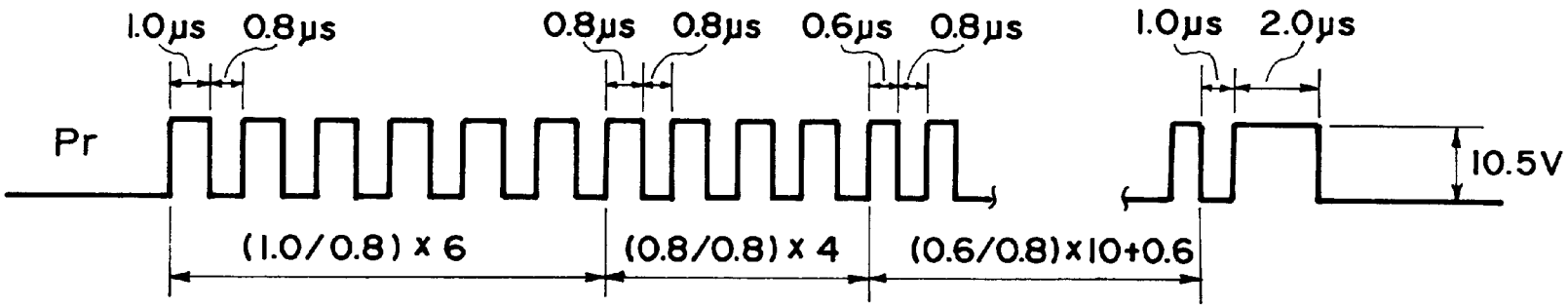

FIG. 10 shows a plurality of pulses Pr including a first group of pulses having a constant pulse width and a constant pause period, a second group of pulses having a shorter pulse width than the first group pulses, and a third group of pulses having a shorter pulse width than the second group pulses.

Figure 11:
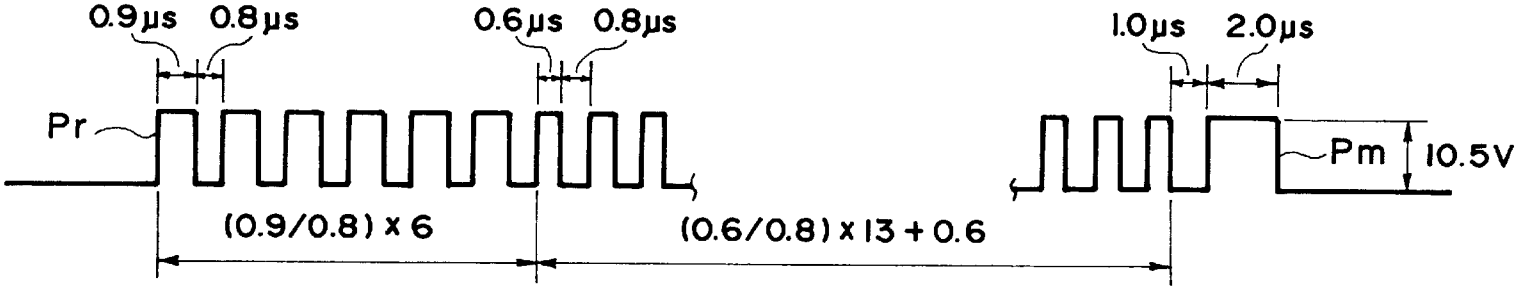

FIG. 11 shows a plurality of pulse Pr including a first group of pulses having a constant pulse width and a constant pause period and a second group of pulses having a shorter pulse width than the first group pulses.

It is also possible to use a plurality of pulses Pr having gradually decreasing pulse widths.

Figure 12:
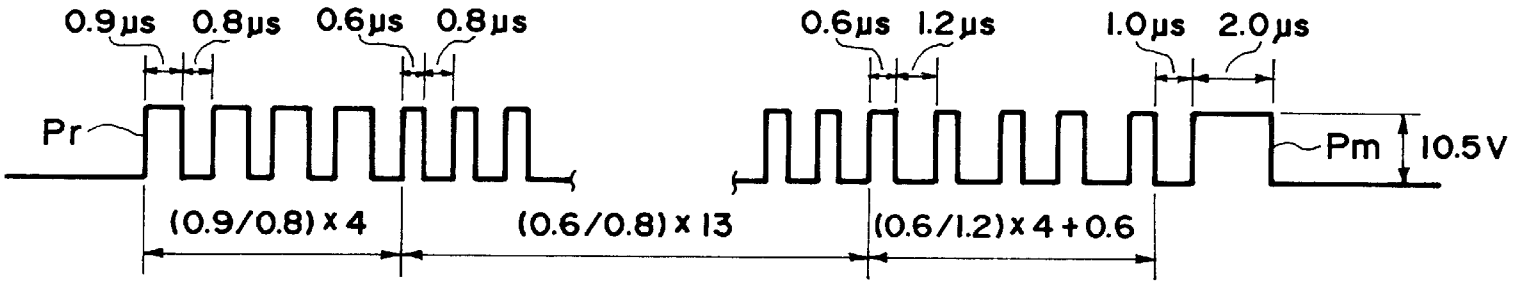

Further, FIG. 12 shows a plurality of preheating pulses Pr including a first group of plural pulses having a constant pulse width and a constant pause period, a second group of plural pulses having a shorter pulse width than the first group pulses, and a third group of plural pulses having a shorter pause period than the second group pulses.

Figure 13:
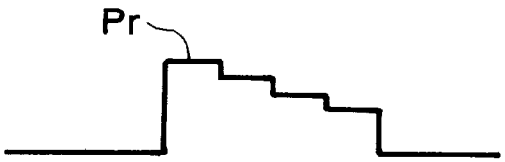
FIG. 13 is a diagram showing an example of a pulse including stepwise varying voltages.

It is also possible to use a preheating pulse Pr having a continuously or discontinuously decreasing voltage so as to decrease the preheating energy. In the present invention, a succession of pulses having different voltages with no pause period therebetween, e.g., pulses having stepwise different voltages as shown in FIG. 13, are taken as a plurality of pulses.

The imparting of a bubble-generating heat energy is generally performed by application of a single pulse (referred to as "bubble-generation pulse"). It is also possible to effect the bubble-generation heating by plural pulses, but a single pulse may be sufficient. Thus, the bubble-generation pulse is generally composed of a single pulse which is generally placed as the last pulse in a pulse train comprising plural pulses for pre-heating and bubble-generation.

Each pulse constituting the pre-heating pulse(s) may preferably have a width of 0.2–1.5 μsec, further preferably 0.3–1.2 μsec, and an amplitude of 8–35 volts, further preferably 10–25 volts. As described, the spacing (pause period) between individual pre-heating pulses may preferably be 0.3–5.0 μsec, further preferably 0.5–4.0 μsec.

The bubble-generation pulse of a single pulse may preferably have a width of 0.8–5.0 μsec, further preferably 1.0–4.0 μsec, and an amplitude of 10–35 volts, further preferably 10–25 volts.

The number of pre-heating pulses may preferably be 10–60, further preferably 20–50.

The normally solid recording material used in the present invention may comprise at least a heat-fusible solid substance and a colorant, and optionally additives for adjusting ink properties and a normally liquid organic solvent, such as an alcohol.

The normally solid recording material may preferably have a melting point in the range of 36° C. to 200° C. Below 36° C., the recording material is liable to be melted or softened according to a change in room temperature to soil hands. Above 200° C., a large quantity of energy is required for liquefying the recording material. More preferably, the melting point is in the range of 36° C.–150° C.

The heat-fusible substance contained in the normally solid recording material may, for example, include: acetamide, p-vaniline, o-vaniline, dibenzyl, m-acetotoluidine, phenyl benzoate, 2,6-dimethylquinoline, 2,6-dimethoxyphenol, p-methylbenzyl alcohol, p-bromoacetophenone, homocatechol, 2,3-dimethoxybenzaldehyde, 2,4-dichloroaniline, dichloroxylylene, 3,4-dichloroaniline, 4-chloro-m-cresol, p-bromophenol, dimethyl oxalate, 1-naphthol, dibutylhydroxytoluene, 1,3,5-trichlorobenzene, p-tertpentylphenol, durene, dimethyl-p-phenylenediamine, tolan, styrene glycol, propionamide, diphenyl carbonate, 2-chloronaphthalene, acenaphthene, 2-bromonaphthalene, indole, 2-acetylpyrrole, dibenzofuran, p-chlorobenzyl alcohol, 2-methoxynaphthalene, tiglic acid, p-dibromobenzene, 9-heptadecanone, 1-tetradecanamine, 1,8-octanediamine, glutaric acid, 2,3-dimethylnaphthalene, imidazole, 2-methyl-8-hydroxyquinoline, 2-methylindole, 4-methylbiphenyl, 3,6-dimethyl-4-octyne-diol, 2,5-dimethyl-3-hexyne-2,5-diol, 2,5-dimethyl-2,5-hexanediol, ethylene carbonate, 1,8-octane diol, 1,1-diethylurea, butyl p-hydroxybenzoate, methyl 2-hydroxynaphthoate, 8-quinolinol, stearylamine acetate, 1,3-diphenyl-1,3-propanedione, methyl m-nitrobenzoate, dimethyl oxalate, phthalide, 2,2-diethyl-1,3-propanediol, N-tert-butylethanolamine, glycolic acid, diacetylmonooxime, and acetoxime. These heat-fusible substances may be used singly or in mixture of two or more species.

The above-mentioned heat-fusible substances include those having various characteristics, such as substances having particularly excellent dischargeability, substances having particularly excellent storability and substances providing little blotting on a recording medium. Accordingly, these heat-fusible substances can be selected depending on desired characteristics.

A heat-fusible substance having a melting point Tm and a boiling point Tb (at 1 atm. herein) satisfying the following formulae (A) and (B) may preferably be used so as to provide a normally solid recording material which is excellent in fixability of recorded images and can effectively convert a supplied thermal energy to a discharge energy.

$$36^\circ\ C. \leqq Tm \leqq 150^\circ\ C. \quad (A)$$

$$150^\circ\ C. \leqq Tb \leqq 370^\circ\ C. \quad (B)$$

The boiling point Tb may preferably satisfy 200° C.≦Tb≦340° C.

The colorant contained in the normally solid recording material may include known ones inclusive of various dyes, such as direct dyes, acid dyes, basic dyes, disperse dyes, vat dyes, sulfur dyes and oil-soluble dyes, and pigments. A particularly preferred class of dyes may include oil-soluble dyes, including those described below disclosed in the color index:

C.I. Solvent Yellow 1, 2, 3, 4, 6, 7, 8, 10, 12, 13, 14, 16, 18, 19, 21, 25, 25:1, 28, 29, etc.;

C.I. Solvent Orange 1, 2, 3, 4, 4:1, 5, 6, 7, 11, 16, 17, 19, 20, 23, 25, 31, 32, 37, 37:1, etc.;

C.I. Solvent Red 1, 2, 3, 4, 7, 8, 13, 14, 17, 18, 19, 23, 24, 25, 26, 27, 29, 30, 33, 35, etc.;

C.I. Solvent Violet 2, 3, 8, 9, 10, 11, 13, 14, 21, 21:1, 24, 31, 32, 33, 34, 36, 37, 38, etc.;

C.I. Solvent Blue 2, 4, 5, 7, 10, 11, 12, 22, 25, 26, 35, 36, 37, 38, 43, 44, 45, 48, 49, etc.;

C.I. Solvent Green 1, 3, 4, 5, 7, 8, 9, 20, 26, 28, 29, 30, 32, 33, etc.;

C.I. Solvent Brown 1, 1:1, 2, 3, 4, 5, 6, 12, 19, 20, 22, 25, ,28, 29, 31, 37, 38, 42, 43, etc.; and C.I. Solvent Blank 3, 5, 6, 7, 8, 13, 22, 22:1, 23, 26, 27, 28, 29, 33, 34, 35, 39, 40, 41, etc.

It is also preferred to use inorganic pigments, such as calcium carbonate, barium sulfate, zinc oxide, lithopone, titanium oxide, chrome yellow, cadmium yellow, nickel titanium yellow, naples yellow, yellow iron oxide, red iron oxide, cadmium red, cadmium mercury sulfide, Prussian blue, and ultramarine; carbon black; and organic pigments, such as azo pigments, phthalocyanine pigments, triphenylmethane pigments and vat-type pigments.

The normally solid recording material can further contain a normally liquid organic solvent, as desired, examples of which may include alcohols, such as 1-hexanol, 1-heptanol, and 1-octanol; alkylene glycols, such as ethylene glycol, propylene glycol, and triethylene glycol; ketones, ketone alcohols, amides, and ethers. Such an organic solvent may have a function of enlarging the size of a bubble generated in the recording material and may preferably have a boiling point of at least 150° C.

As described hereinabove, according to the present invention, a large quantity of heat energy can be imparted to the recording material, so that heat-melted droplets of the normally solid recording material can be ejected out of the ejection outlet at an increased speed. As a result the location of recording material droplets attached to the recording material is stabilized to provide a recorded image, and ejection failure is also prevented.

Hereinbelow, the present invention will be described more specifically based on Examples.

EXAMPLE 1

Image formation (recording) was performed by using a recording apparatus shown in FIG. 1 equipped with a recording head similar to the one shown in FIG. 2 except for the use of straight nozzles 15 and the number of the nozzles.

Referring to FIG. 2, the recording material included 48 nozzles 15 at a density of 400 nozzles/inch each having. Each nozzle 15 had a 0.13 μm-thick heater 2 of $HfB_2$ covered successively a 1.0 μm-thick $SiO_2$ protective layer and a 0.1 μm-thick Ta protective layer having an area of about 1280 $\mu m^2$, a nozzle width of about 40 μm and a nozzle height of 27 μm at the heater position, and an orifice 15 having a sectional area of about 1080 $\mu m^2$ (width of 40 μm and height of 27 μm) disposed at an about 25 μm from the center of the heater 2. The heater 2 showed an electric resistance of about 29 Ω.

The recording material was a normally solid one comprising the following components and melt-heated at 80° C. or higher for recording.

| | |
|---|---|
| Lauric acid | 67 wt. % |
| Carnauba wax | 30 wt. % |
| Dye (Solvent Black 3) | 3 wt. % |

The heater 2 was supplied with preheating pulses Pr and a bubble-generating pulse Pm as shown in FIG. 9. The preheating pulses Pr included 6 pulses with a pulse width of 0.6 μsec and a pause period of 0.8 μsec, followed by 14 pulses with a pulse width of 0.6 μsec and a pause period of 2.0 μsec. the bubble-generating pulse with a pulse width of 2.0 μsec was applied after a pause period of 1.0 μsec following the preheating pulses. The pulse voltage was 10.5 volts for both the preheating pulses and the bubble-generating pulse. The above set of the preheating pulses and the bubble-generating pulse was applied at a repeating cycle of 500 μsec (drive frequency of 2 kHz).

Under the above conditions, a checker pattern having black and white elements each comprising 12×12 dots (pixels) was recorded on plain paper (commercially available copying paper). As a result, clear recorded images were formed under very stable discharge of the recording material.

EXAMPLE 2

Recorded images were formed in the same manner as in Example 1 except that a pulse train including preheating pulses and a bubble-generating pulse (the same as in FIG. 9) shown in FIG. 8 was used. The preheating pulses shown in FIG. 8 included a succession of 6 0.6 μsec-wide pulses with a pause period of 0.8 μsec, then 3 0.6 μsec-wide pulses with a pause period of 1.6 μsec and further 11 0.6 μsec-wide pulses with a pause period of 2.0 μsec. The pulse voltage was 10.5 volts for both the preheating pulses and the bubble-generating pulse.

As a result, clear recorded images were formed under very stable discharge of the recording material.

EXAMPLE 3

Recorded images were formed in the same manner as in Example 1 except that a pulse train including preheating pulses and a bubble-generating pulse shown in FIG. 7 was used. The preheating pulses shown in FIG. 7 included a succession of 21 0.6 μsec-wide pulses with pause periods therebetween increasing from 0.8 μsec to 2.8 μsec by an increment of 0.1 μsec for each pause period. The pulse voltage was 10.5 volts for both the preheating pulses and the bubble-generating pulse (pulse width=2.0 μsec).

As a result, clear recorded images were formed under very stable discharge of the recording material.

EXAMPLE 4

Recording was performed in the same manner as in Example 1 except that a recording head for a commercially available bubble-jet printer ("BJ130J", mfd. by Canon K.K.) and a normally solid recording material comprising the following components was used as the recording material.

| | |
|---|---|
| Ethylene carbonate | 60 wt. % |
| 1,12-Dodecanediol | 37 wt. % |
| Dye (Solvent Black 3) | 3 wt. % |

As a result, clear recorded images were formed similarly as in Example 1.

EXAMPLE 5

Recorded images were formed in the same manner as in Example 1 except that a pulse train including preheating pulses and a bubble-generating pulse (the same as in FIG. 9) shown in FIG. 11 was used. The preheating pulses shown in FIG. 11 included a succession of 6 0.9 μsec-wide pulses with a pause period of 0.8 μsec and then 14 0.6 μsec-wide pulses with a pause period of 0.8 μsec. The pulse voltage was 10.5 volts for both the preheating pulses and the bubble-generating pulse.

As a result, clear recorded images were formed under very stable discharge of the recording material.

EXAMPLE 6

Recorded images were formed in the same manner as in Example 1 except that a pulse train including preheating pulses and a bubble-generating pulse (the same as in FIG. 9) shown in FIG. 12 was used. The preheating pulses shown in FIG. 12 included a succession of 4 0.9 μsec-wide pulses with a pause period of 0.8 μsec, then 13 0.6 μsec-wide pulses with a pause period of 0.8 μsec and further 5 0.6 μsec-wide pulses with a pause period of 1.2 μsec. The pulse voltage was 10.5 volts for both the preheating pulses and the bubble-generating pulse.

As a result, clear recorded images were formed under very stable discharge of the recording material.

EXAMPLE 7

Recorded images were formed in the same manner as in Example 1 except that a pulse train including preheating pulses and a bubble-generating pulse (the same as in FIG. 9) shown in FIG. 10 was used. The preheating pulses shown in FIG. 10 included a succession of 6 1.0 μsec-wide pulses with a pause period of 0.8 μsec, then 4 0.8 μsec-wide pulses with a pause period of 0.8 μsec and further 11 0.6 μsec-wide pulses with a pause period of 0.8 μsec. The pulse voltage was 10.5 volts for both the preheating pulses and the bubble-generating pulse.

As a result, clear recorded images were formed under very stable discharge of the recording material.

COMPARATIVE EXAMPLE

Recorded images were formed in the same manner as in Example 1 except that a pulse train including 20 0.6 μsec-wide preheating pulses with a constant pause period of 1.0 μsec and a 2.0 μsec-wide bubble-generating pulse following a pause period of 1.0 μsec after the preheating pulses. The pulse voltage was 10.5 μsec for both the preheating pulses and the bubble-generating pulse.

As a result, the location of the recording material droplets attached on the recording paper was somewhat fluctuated to result in recorded images which were inferior in clearness to those of claim 1.

What is claimed is:

1. A jet recording method, comprising the steps of:

placing a recording material in a liquid state within a plurality of nozzles;

heating the recording material to generate a bubble within the recording material in each nozzle by application from a bubble-generating heater of bubble-generating heat energy corresponding to a given recording signal, thereby ejecting a droplet of the recording material out of the nozzle onto a recording medium; and applying to the recording material, a plurality of preheating pulses of equal height providing preheating energy from the bubble-generating heater, the preheating energy having an energy density per unit time which decreases with time until application of the bubble-generating heat energy, the decrease in the energy density per unit time corresponding to a decrease in pulse width or number of pulses per unit time of the preheating pulses, wherein the preheating energy is provided to the recording material so as not to cause a substantial change in volume of droplets ejected out of each nozzle but to stabilize a bubble-through mode jet recording such that each bubble generated in said bubble generating heating step is caused to communicate with ambience, thereby ejecting each droplet of the recording material in a substantially constant volume and along a substantially constant ejection path.

2. A method according to claim 1, wherein 60–90% of a preheating energy is applied within a first half of a period of time during which the preheating pulses are applied.

3. A method according to claim 1, wherein said plurality of preheating pulses are applied while a pause period between adjacent two pulses among the plurality of pulses is gradually increased after application of each pulse.

4. A method according to claim 1, wherein said plurality of preheating pulses include a first group of plural pulses having a constant pulse width and a constant pause period between pulses, and a second group of plural pulses having a longer pause period than the first group of plural pulses.

5. A method according to claim 1, wherein said plurality of preheating pulses include a first group of plural pulses having a constant pulse width and a constant pause period between pulses, and a second group of plural pulses having a shorter pulse width than the first group of plural pulses.

6. A method according to claim 1, wherein the recording material is solid at room temperature.

* * * * *

UNITED STATES PATENT AND TRADEMARK OFFICE

CERTIFICATE OF CORRECTION

PATENT NO. : 5,963,233

DATED : October 5, 1999

INVENTOR(S) : KATSUHIRO SHIROTA, ET AL.

It is certified that error appears in the above-identified patent and that said Letters Patent is hereby corrected as shown below:

COLUMN 1:
Line 15, ",4,723,129" should be deleted.

COLUMN 2:
Line 14, "prior" should read --prior to--.

COLUMN 7:
Line 17, "material" should read --head--.
Line 18, "nozzles/inch each having." should read --nozzles/inch.--.
Line 20, "successively" should read --successively by--.

Signed and Sealed this

Twenty-seventh Day of June, 2000

*Attest:*

Q. TODD DICKINSON

*Attesting Officer*

*Director of Patents and Trademarks*